US005797338A

United States Patent [19]

Stone

[11] Patent Number: 5,797,338

[45] Date of Patent: Aug. 25, 1998

[54] ALTERNATING SEAM FOR GARMENTS AND METHOD OF SEWING THE ALTERNATING SEAM

[76] Inventor: Nancy A. Stone, P.O. Box 241, Stillwater, Minn. 55082

[21] Appl. No.: 779,531

[22] Filed: Jan. 7, 1997

[51] Int. Cl.[6] ..... D05B 93/00; A41D 1/06

[52] U.S. Cl. ..... 112/475.13; 112/441; 2/275

[58] Field of Search ..... 112/475.04, 475.09, 112/475.13, 475.26, 441; 2/69, 275, 236, 237, 243.1, 301, 311, 239, 240, 241, 76, 79, 227

[56] References Cited

U.S. PATENT DOCUMENTS

| | | | |
|---|---|---|---|
| 2,384,079 | 9/1945 | Davis | 2/241 X |
| 4,653,122 | 3/1987 | Zanoni | 112/475.13 X |
| 5,050,244 | 9/1991 | Kleinman | 2/236 X |
| 5,505,149 | 4/1996 | Schramayr et al. | 112/475.09 X |

OTHER PUBLICATIONS

"Living Yoga™ Stretchwear", Living Arts Winter 1997 catalogue, p. 15.

Photographs of a pair Living Yoga™ Stretchwear leggings, marketed in the United States by Living Arts, P.O. Box 2939, Venice, California 90291–2939.

Picture on p. 133 of Yoga Journal, Mar./Apr. 1997.

*Primary Examiner*—Ismael Izaguirre

*Attorney, Agent, or Firm*—Merchant, Gould, Smith, Edell, Welter & Schmidt, P.A.

[57] ABSTRACT

The present invention relates to an alternating seam for joining two pieces of stretchable fabric. The alternating seam can be used for making garments, such as pant garments. The alternating seam has a non-inverted seam that extends from a seam inversion point to a desired length below the seam inversion point. Outer sides of the two fabric pieces are in opposing contact with each other along the non-inverted seam. The alternating seam also includes an inverted seam that extends upwardly from the seam inversion point. Inner sides of the two fabric pieces are in opposing contact with each other along the inverted seam. The alternating seam includes an overlapping seam, which may be an extension of the non-inverted seam, extending upwardly from the seam inversion point and curving outwardly to the inverted seam. A pant garment using the alternating seam can be made without any fasteners or elastic. When worn by a person, an upper edge of the pant garment can be rolled down and seam allowances in the upper portion of the pant garment are concealed from view.

22 Claims, 3 Drawing Sheets

FIG. 4
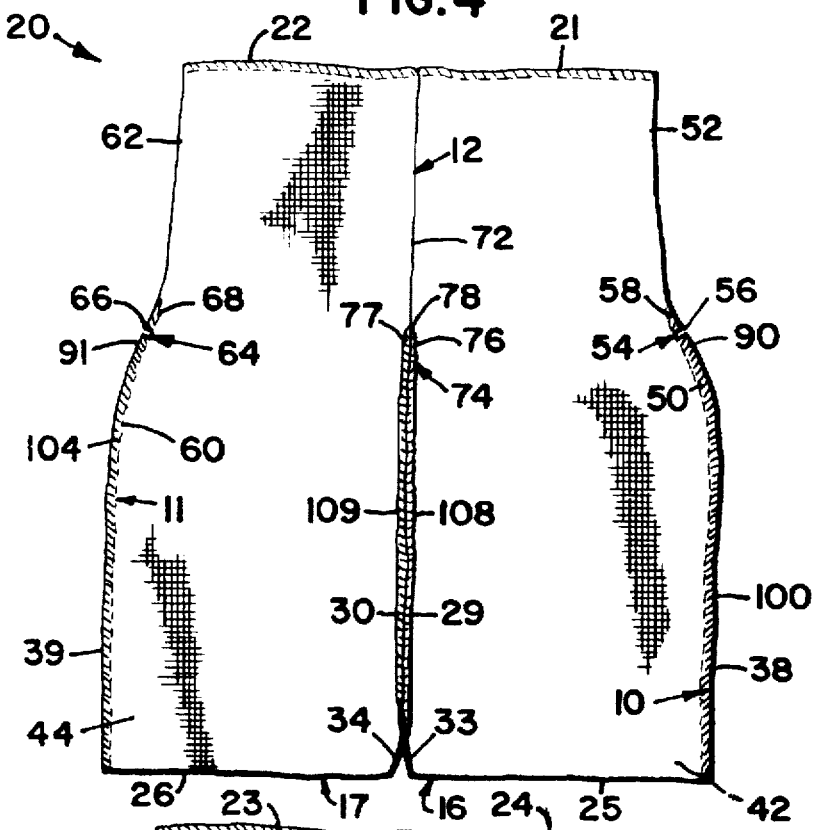
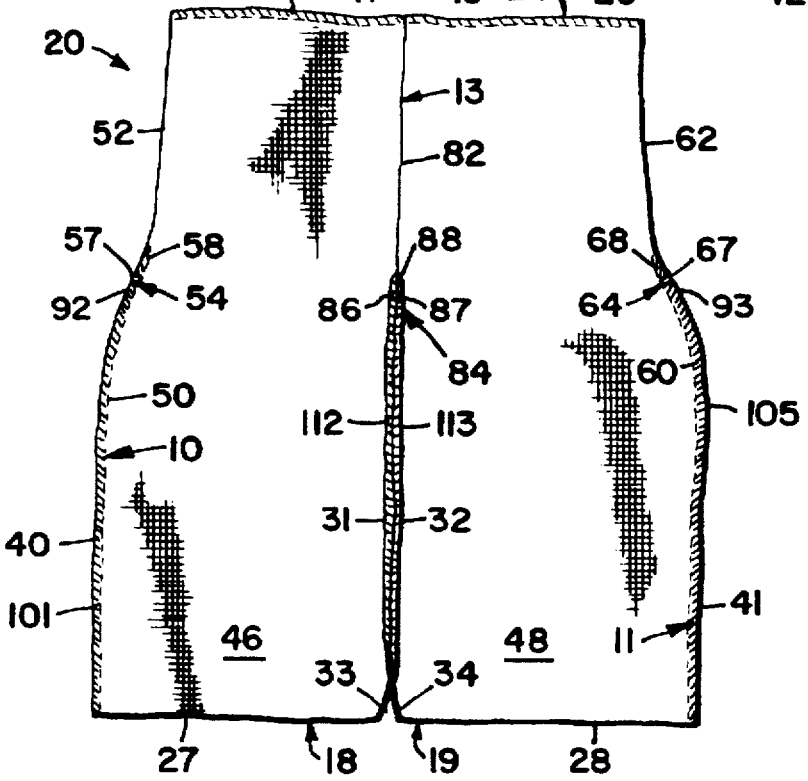
FIG. 5

ALTERNATING SEAM FOR GARMENTS AND METHOD OF SEWING THE ALTERNATING SEAM

TECHNICAL FIELD

The present invention relates generally to garments. More particularly, the present invention relates to an alternating seam for garments.

BACKGROUND

Over the past several years, many people have developed an avid interest in exercising and recreational sports. For example, many people enjoy aerobics, walking, running, yoga, skating, biking and the like. The interest in such activities has motivated clothing manufacturers to create new types of garments that are both comfortable and fashionable. Such garments are designed to be worn during exercise or participation in recreational sports, while also appearing fashionable on the wearer. Many people now wear such garments during normal daily activities.

Although many garments currently exist on the market that are designed to promote comfort and wearability during exercise, pant garments, such as, for example, long pants, shorts, leggings, stretch pants, sweat pants, skorts and the like, generally have immovable waistbands and either closure devices or elastic to secure the garment to the wearer's body. A closure device may include, for example, a zipper, buttons, hooks, snaps or hook and loop fasteners. If closure devices are used, then an opening or slit in the garment typically extends vertically through the waistband and down a portion of the garment just below the waistband for opening and closing the top, or entry portion of the garment. The slit in the garment must be sufficiently long to permit opening the top portion of the garment wide enough to permit a wearer to pull the garment over the wearer's legs and hips. If elastic is used, rather than or in addition to fasteners, the elastic is generally sewn into the waistband.

Elastic and fasteners used in a waistband can both become problematic for a wearer. Elastic that is too tight may cause discomfort, including pain and redness around the waist of the wearer. In addition, the wearer may become self-conscious due to bulges created by the tight elastic. On the other hand, elastic that is too loose can create an uncomfortable feeling for the wearer that the garment is falling off, which can inhibit the wearer's physical movements during exercise and participation in recreational sports. Many times, elastic that comfortably fits the wearer initially, loses its elasticity over time, after washing, drying and wearing. Fasteners may also create problems for the wearer. Types of clothing that utilize fasteners or closure devices in the waistband typically do not have any "give" around the waistband. Thus, certain movements can be uncomfortable for the wearer because the clothing may become too tight as the wearer performs certain movements. In addition, wearing garments having a fastener in the waistband during exercise and recreational sports can cause strain on the fastener and the stitching and material around the fastener. Repeated strain may eventually cause the fastener to break, the material to tear, or the stitching to rip.

In constructing garments, waistbands usually have several pattern pieces that must be combined with several other pattern pieces designed to surround legs and hips of the wearer. Generally, the greater the number of pattern pieces, the more difficult the garment is to make. In addition, alterations to waistbands are usually difficult and time-consuming.

The present invention provides a solution to this and other problems and offers other advantages over the prior art.

SUMMARY

The present invention relates to an alternating seam for joining two pieces of stretchable fabric. The alternating seam includes a non-inverted seam that extends from a seam inversion point to a desired length below the seam inversion point. Outer sides of the two fabric pieces are in opposing contact with each other along the non-inverted seam. The alternating seam also includes an inverted seam that extends upwardly from the seam inversion point. Inner sides of the two fabric pieces are in opposing contact with each other along the inverted seam.

In accordance with another embodiment of the present invention, the non-inverted seam of the alternating seam also includes an overlapping seam that extends upwardly from the seam inversion point and curves outwardly to the inverted seam. The overlapping seam is sewn on the inner sides of the two fabric pieces with two seam allowances formed by the inverted seam folded therebetween.

In accordance with yet another embodiment of the present invention, at least two alternating seams as previously described are used to construct a garment, such as, for example, a pant garment, that can be worn by a person.

According to yet another embodiment, the present invention relates to a method of sewing an alternating seam. At least two stretchable fabric pieces are provided. Longitudinal edges of the two fabric pieces are aligned with inner sides of the two fabric pieces in opposing contact with each other. An inverted seam is sewn on the outer sides of the two fabric pieces, which is laterally spaced from upper portions of the longitudinal edges of the two fabric pieces. The inverted seam has one end that curves outwardly to at least one of the longitudinal edges of the two fabric pieces. Two slits are made at the longitudinal edges of the two fabric pieces adjacent to the curved one end of the inverted seam. The two fabric pieces are inverted such that the outer sides of the two fabric pieces are in opposing contact with each other and the longitudinal edges of the two fabric pieces are in alignment. A non-inverted seam is sewn and extends downwardly from the two slits. An overlapping seam is sewn and extends upwardly from the non-inverted seam adjacent to the two slits and curves outwardly to the inverted seam.

BRIEF DESCRIPTION OF THE DRAWINGS

FIG. 4 is a front elevation view of the inner side of the pant garment of FIG. 1;

FIG. 5 is a back elevation view of the inner side of the pant garment of FIG. 1.

DETAILED DESCRIPTION

Figure 1:
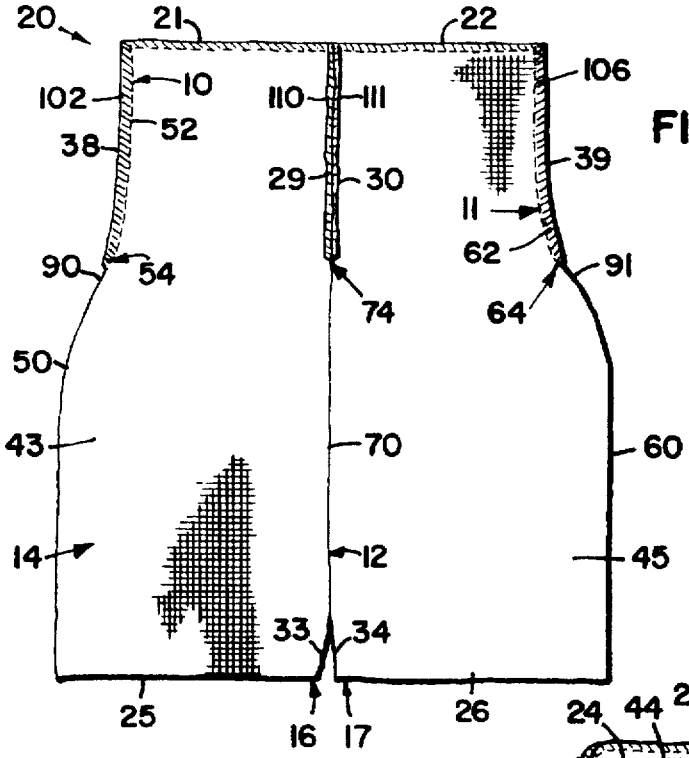
FIG. 1 is a front elevation view of an outer side of a pant garment according to the present invention.
Figure 2:
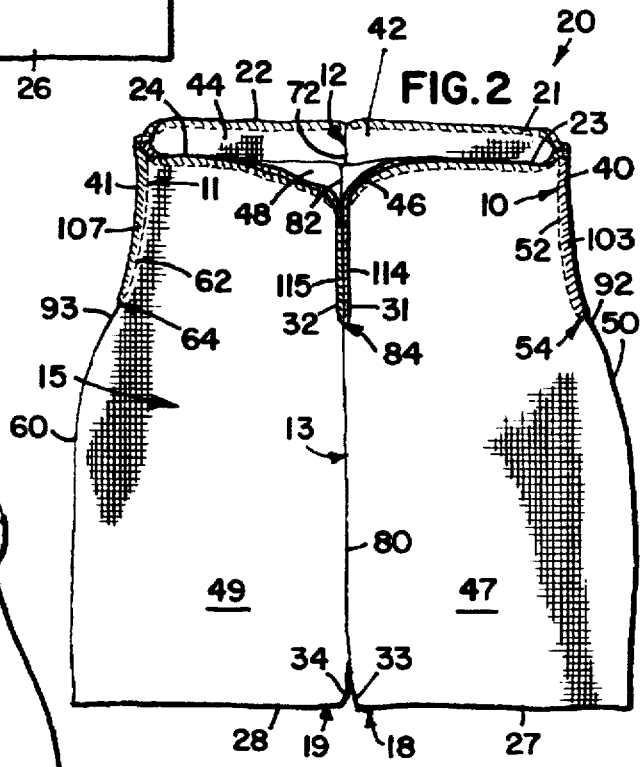
FIG. 2 is a back elevation view of the pant garment of FIG. 1 showing a front portion of a top edge of the pant garment folded down to reveal front and back portions of an inner side of the pant garment.
Figure 3:
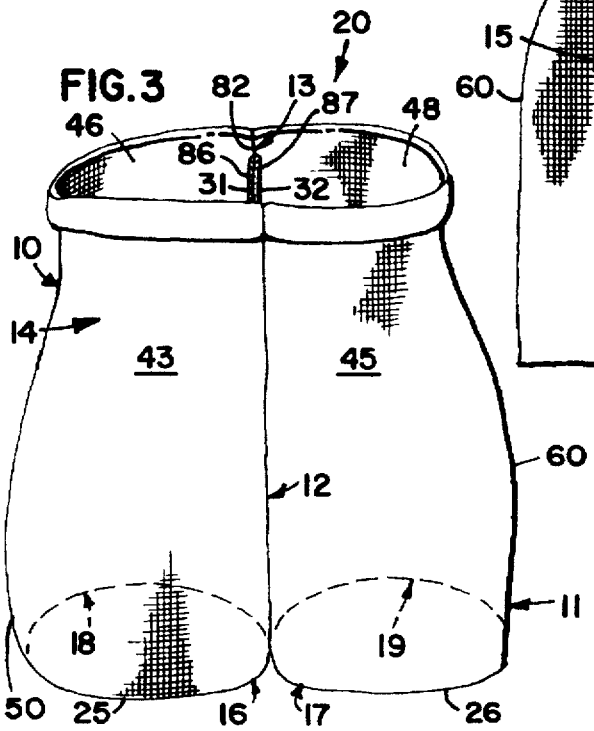
FIG. 3 is a front, top perspective view of the pant garment of FIG. 1, wherein an upper edge of the pant garment has been rolled down around the outer side of the pant garment.

With reference to the drawings in which like elements are numbered identically throughout, a detailed description of the invention is provided. This description does not limit the scope of the invention, which is limited only by the scope of the attached claims.

In general terms, the present invention relates to an alternating seam, such as first alternating seam 10, for joining a first piece of stretchable fabric 14 to a second piece of stretchable fabric 15. The first alternating seam 10 has a first non-inverted seam 50 and a first inverted seam 52. The first alternating seam 10 has a first seam inversion point 54 at one end of the first inverted seam 52. The first inverted seam 52 extends upwardly from the first seam inversion point 54. The first non-inverted seam 50 extends downwardly from the first seam inversion point 54 and includes an overlapping seam that extends upwardly a short distance from the first seam inversion point 54. Upper portions of the first and second fabric pieces 14 and 15 can be rolled down from upper edges 46 and 47 such that first inverted seam allowances 24 and 25 of the first inverted seam 52 are concealed and only the first inverted seam 52 between the front and back fabric pieces 14 and 15 is visible.

FIGS. 1–5 are drawings representing various views of a pant garment 20 incorporating first, second, third and fourth alternating seams 10, 11, 12 and 13, respectively, according to the present invention. Each of the first, second, third and fourth alternating seams 10–13 have first, second, third and fourth non-inverted seams 50, 60, 70 and 80, respectively, and first, second, third and fourth inverted seams 52, 62, 72, and 82, respectively.

The pant garment 20 is made up of a front piece of stretchable fabric 14 and a back piece of stretchable fabric 15. In the embodiment shown in FIGS. 1 through 4, the front fabric piece 14 is made of a right front fabric piece 16 and a left front fabric piece 17, having inner sides 42 and 44 and outer sides 43 and 45, respectively. The back fabric piece 15 is made of a right back fabric piece 18 and a left back fabric piece 19, having inner sides 46 and 48 and outer sides 47 and 49, respectively. The right and left front fabric pieces 16 and 17 have, respectively, longitudinal edges 38 and 39, upper edges 21 and 22, bottom edges 25 and 26, inner edges 29 and 30, and inner leg edges (not shown). The right and left back fabric pieces 18 and 19 have, respectively, longitudinal edges 40 and 41, upper edges 23 and 24, bottom edges 27 and 28, inner edges 31 and 32, and inner leg edges (not shown). Any stretchable fabric, such as, for example, a knit fabric, may be used. In one preferred embodiment, the fabric is Natural Lycra Jersey from ECOSPORT, 92 Kansas Street, Hackensack, N.J. 07601.

It will be apparent to those in the art that the front and back fabric pieces 14 and 15 may be single pieces of fabric rather than a combination of two separately cut fabric pieces, such as right and left front fabric pieces 16 and 17 and right and left back fabric pieces 18 and 19. For example, the present invention can be utilized in a skirt garment wherein a single front fabric piece and a single back fabric piece can be utilized with only the first and second alternating seams 10 and 11 as these seams are shown in FIGS. 1–5.

The longitudinal edges 38 and 39 of the right and left front fabric pieces 16 and 17 and the longitudinal edges 40 and 41 of the right and left back fabric pieces 18 and 19 are each shaped to substantially follow the contour of a person's waist and hips, wherein each of the longitudinal edges has an inflection point. The longitudinal edges 38 and 39 of the right and left front fabric pieces 16 and 17 have inflection points 90 and 91, respectively. The longitudinal edges 40 and 41 of the right and left back fabric pieces 18 and 19 have inflection points 92 and 93, respectively. The longitudinal edges 38 and 39 of the right and left front fabric pieces 16 and 17 extend downwardly from the upper edges 21 and 23, respectively, and curve outwardly to their respective inflection points 90 and 91, and then slope outwardly and downwardly to the bottom edges 25 and 26, respectively. The longitudinal edge 40 of the right back fabric piece 18 mirrors the contour of the longitudinal edge 38 of the right front fabric piece 16. The longitudinal edge 41 of the left back fabric piece 19 mirrors the contour of the longitudinal edge 39 of the left front fabric piece 17.

It will be apparent to those in the art that, while it is preferable for fabric pieces to be cut such that seams can be sewn to follow the contour of the fabric edges, fabric edges can have any shape so long as seams having the desired contour are sewn on the fabric pieces.

Each of the alternating seams 10–13 has a corresponding seam inversion point 54, 64, 74 and 84, respectively. The first seam inversion point 54 is preferably fixed at an area slightly above the inflection point 90 of the right front fabric piece 16 and the inflection point 92 of the right back fabric piece 18. Similarly, the second seam inversion point 64 is preferably fixed at an area slightly above the inflection point 91 of the left front fabric piece 17 and the inflection point 93 of the left back fabric piece 19. It will be apparent that the seam inversion points 54 and 64 may vary in placement along the contour of the longitudinal edges 38 and 40 and 39 and 41, depending upon the shape and size of the corresponding fabric pieces. Similarly, the placement of the seam inversion points 74 and 84 will vary in placement along the inner edges 29 and 30 and 31 and 32.

In one preferred embodiment, each of the seam inversions points 54, 64, 74 and 84 is positioned between 5 inches and 7 inches, such as, for example, approximately 6 inches, below at least one of the upper edges 21–24 of the fabric pieces 16–19. Thus, in one embodiment, each of the inverted seams 52, 62, 72 and 82 is between 5 and 7 inches long, such as, for example, approximately 6 inches long. It will be apparent to those in the art, however, that the seam inversion points 54, 64, 74 and 84 simply need to be fixed at points along the longitudinal and inner edges of the fabric pieces such that when an upper portion of the garment is rolled down to form a desired rolled waistband, the resulting rolled waistband does not slip downwardly below the seam inversion points 54, 64, 74 and 84, exposing seam allowances (as described hereinafter) of the non-inverted seams 50, 60, 70 and 80. In the embodiment shown in FIGS. 1–5, the first, second, third and fourth seam inversion points 54, 64, 74 and 84 are substantially in horizontal alignment across the pant garment 20.

Figure 6:
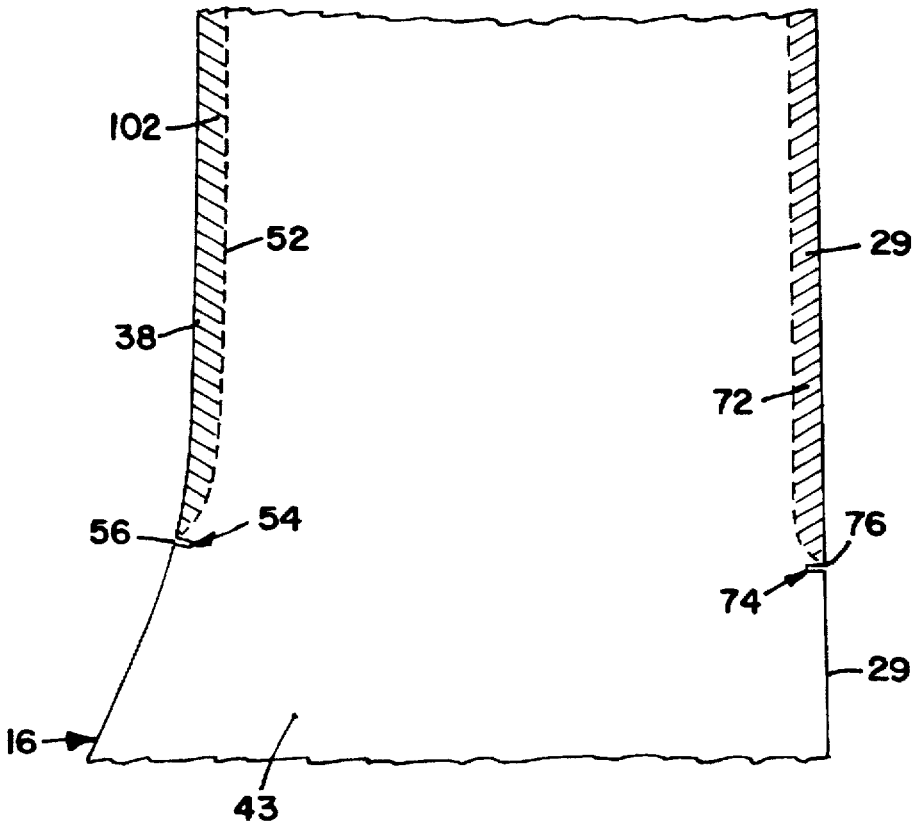
FIG. 6 is a partial front elevation view of an outer side of a right front fabric piece of a pant garment that has been partially constructed according to the present invention.

The first and third seam inversion points 54 and 74 are shown in an enlarged partial drawing of the partially constructed right front fabric piece 16 of the present invention in FIG. 6. The first seam inversion point 54 includes a pair of corresponding slits 56 and 57 transverse to the longitudinal edges 38 and 40 of the right front and right back fabric pieces 16 and 18, respectively. Similarly, the second seam inversion point 64 has a pair of corresponding slits 66 and 67 transverse to the longitudinal edges 39 and 41 of the left front and left back fabric pieces 17 and 19, respectively. The third seam inversion point 74 also has two corresponding slits 76 and 77 transverse to the inner edges 29 and 30 of the right and left front fabric pieces 16 and 17, respectively. Finally, the fourth seam inversion point 93 has two corresponding slits 86 and 87 transverse to the inner edges 31 and 32 of the right and left back fabric piece 18 and 19.

The first inverted seam 52 is sewn on the outer sides 43 and 47 of the right front and right back fabric pieces 16 and 18 when the longitudinal edges 38 and 40 of the right front and right back fabric pieces 16 and 18 are aligned and their inner sides 42 and 46 oppose each other. The first inverted seam 52 is laterally spaced from upper portions of the longitudinal edges 38 and 40 of the right front and right back fabric pieces 16 and 18, and extends from one end at the upper edges 21 and 23 of the right front and right back fabric pieces 16 and 18 to an opposite end that curves outwardly to the longitudinal edges 38 and 40 at the first seam inversion point 54. The first non-inverted seam 50 is sewn on the inner sides 42 and 46 of the right front and right back fabric pieces 16 and 18 when the longitudinal edges 38 and 40 of the right front and right back fabric pieces 16 and 18 are aligned and their outer sides 43 and 47 oppose each other. The first non-inverted seam 50 extends downwardly from the first seam inversion point 54 to the bottom edges 25 and 27 of the right front and right back fabric pieces 16 and 18. The first non-inverted seam 50 is laterally spaced from lower portions of the longitudinal edges 38 and 40 of the right front and right back fabric pieces 16 and 18, and includes an overlapping seam 58 that extends upwardly from the first seam inversion point 54 and curves outwardly to the first inverted seam 52. The first overlapping seam 58 overlaps seam allowances 102 and 103 formed by the first inverted seam 52 and folded between the outer sides 43 and 47 of the right front and right back fabric pieces 16 and 18.

The second inverted seam 62 is sewn on the outer sides 45 and 49 of the left front and left back fabric pieces 17 and 19 when the longitudinal edges 39 and 41 of the left front and left back fabric pieces 17 and 19 are aligned and the inner sides 44 and 48 of the left front and left back fabric pieces 17 and 19 oppose each other. The second inverted seam 62 is laterally spaced from upper portions of the longitudinal edges 39 and 41 of the left front and left back fabric pieces 17 and 19, and extends from one end at the upper edges 22 and 24 of the left front and left back fabric pieces 17 and 19 to an opposite end that curves outwardly to the longitudinal edges 39 and 41 at the second seam inversion point 64. The second non-inverted seam 60 is sewn on the inner sides 44 and 48 of the left front and left back fabric pieces 17 and 19 when the longitudinal edges 39 and 41 of the left front and left back fabric pieces 17 and 19 are aligned and the outer sides 45 and 49 of the left front and left back fabric pieces 17 and 19 oppose each other. The second non-inverted seam 60 extends downwardly from the second seam inversion point 64 to the bottom edges 26 and 28 of the left front and left back fabric pieces 17 and 19. The second non-inverted seam 60 is laterally spaced from lower portions of the longitudinal edges 39 and 41 of the left front and left back fabric pieces 17 and 19, and includes an overlapping seam 68 that extends upwardly from the second seam inversion point 64 and curves outwardly to the second inverted seam 62. The second overlapping seam 68 overlaps seam allowances 106 and 107 formed by the second inverted seam 62 and folded between the outer sides 45 and 49 of the left front and left back fabric pieces 17 and 19.

The third inverted seam 72 is sewn on the outer sides 43 and 45 of the right and left front fabric pieces 16 and 17 when the inner edges 29 and 30 of the right and left front fabric pieces 16 and 17 are aligned and their inner sides 42 and 44 oppose each other. The third inverted seam 72 is laterally spaced from upper portions of the inner edges 29 and 30 of the right and left front fabric pieces 16 and 17, and extends from one end at the upper edges 21 and 22 of the right and left front fabric pieces 16 and 17 to an opposite end that curves outwardly to the inner edges 29 and 30 at the third seam inversion point 74. The third non-inverted seam 70 is sewn on the inner sides 42 and 44 of the right and left front fabric pieces 16 and 17 when the inner edges 29 and 30 are aligned and the outer sides 43 and 45 of the right and left front fabric pieces 16 and 17 oppose each other. The third non-inverted seam 70 extends downwardly from the third seam inversion point 74 to an area adjacent the bottom of the inner edges 29 and 30 of the right and left front fabric pieces 16 and 17. The third non-inverted seam 70 is laterally spaced from lower portions of the inner edges 29 and 30 of the right and left front fabric pieces 16 and 17, and includes an overlapping seam 78 that extends upwardly from the third seam inversion point 74 and curves outwardly to the third inverted seam 72. The second overlapping seam 78 overlaps seam allowances 110 and 111 formed by the third inverted seam 72 and folded between the outer sides 43 and 45 of the right and left front fabric pieces 16 and 17.

The fourth inverted seam 82 is sewn on the outer sides 47 and 49 of the right and left back fabric pieces 18 and 19 when the inner edges 31 and 32 of the right and left back fabric pieces 18 and 19 are aligned and the inner sides 46 and 48 oppose each other. The fourth inverted seam 82 is laterally spaced from upper portions of the inner edges 31 and 32 of the right and left back fabric pieces 18 and 19, and extends from one end at the upper edges 23 and 24 of the right and left back fabric pieces 18 and 19 to an opposite end that curves outwardly to the inner edges 31 and 32 at the fourth seam inversion point 84. The fourth non-inverted seam 80 is sewn on the inner sides 46 and 48 of the right and left back fabric pieces 18 and 19 when the inner edges 31 and 32 are aligned and the outer sides 47 and 49 of the right and left back fabric pieces 18 and 19 oppose each other. The fourth non-inverted seam 80 extends downwardly from the fourth seam inversion point 84 an area adjacent to the bottom of the inner edges 31 and 32 of the right and left back fabric pieces 18 and 19. The fourth non-inverted seam 80 is laterally spaced from lower portions of the inner edges 31 and 32 of the right and left back fabric pieces 18 and 19, and includes an overlapping seam 88 that extends upwardly from the fourth seam inversion point 84 and curves outwardly to the fourth non-inverted seam 80. The fourth overlapping seam 88 overlaps seam allowances 114 and 115 formed by the fourth inverted seam 82 and folded between the outer sides 47 and 49 of the right and left back fabric pieces 18 and 19.

It will be apparent to those in the art that the overlapping seams 58, 68, 78 and 88 could be downward seam extensions of the inverted seams 52, 62, 72 and 82, respectively, rather than upward seam extensions of the non-inverted seams 50, 60, 70 and 80, respectively. In this regard, the upper ends of the non-inverted seams 50, 60, 70 and 80 would each curve outwardly to their respective longitudinal or inner edges at their respective seam inversion points. The inverted seams 52, 62, 72 and 82 would not curve outwardly to their respective longitudinal and inner edges at their respective seam inversion points, but rather, would each have an overlapping seam extending from their respective seam inversion points downwardly and outwardly to the non-inverted seams 50, 60, 70 and 80. Thus, construction of the inverted and non-inverted seams would be reversed at the seam inversion points.

Each of the non-inverted seams 50, 60, 70 and 80 and each of the inverted seams 52, 62, 72 and 82 forms seam allowances. Seam allowances are the portions of fabric between the fabric edges and the adjacent seam. Seam allowances 100 and 101 are formed between the first non-inverted seam 50 and the longitudinal edges 38 and 40 of the right front and right back fabric pieces 16 and 18, respectively. Seam allowances 102 and 103 are formed between the first inverted seam 52 and the longitudinal edges 38 and 40 of the right front and right back fabric pieces 16 and 18, respectively. Seam allowances 104 and 105 are formed between the second non-inverted seam 60 and the longitudinal edges 39 and 41 of the left front and left back fabric pieces 17 and 19, respectively. Seam allowances 106 and 107 are formed between the second inverted seam 62 and the longitudinal edges 39 and 41 of the left front and left back fabric pieces 17 and 19, respectively. Seam allowances 108 and 109 are formed between the third non-inverted seam 70 and the inner edges 29 and 30 of the right and left front fabric pieces 16 and 17, respectively. Seam allowances 110 and 111 are formed between the third inverted seam 72 and the inner edges 29 and 30 of the right and left front fabric pieces 16 and 17, respectively. Seam allowances 112 and 113 are formed between the fourth non-inverted seam 80 and the inner edges 31 and 32 of the right and left front fabric pieces 18 and 19, respectively. Seam allowances 114 and 115 are formed between the fourth inverted seam 82 and the inner edges 31 and 32 of the right and left front fabric pieces 18 and 19, respectively.

Sewing an alternating seam, such as first alternating seam 10 can be accomplished as follows. First, the inner sides 42 and 46 of the right front and right back fabric pieces 16 and 18 are placed together and the longitudinal edges 38 and 40 of the right front and right back fabric pieces 16 and 18 are aligned with each other. A first inverted seam 52 is sewn on the outer sides 43 and 47 of the right front and right back fabric pieces 16 and 18 from the upper edges 21 and 23 of the right front and right back fabric pieces 16 and 18 down to the first seam inversion point 54. The first inverted seam 52 is laterally spaced from the longitudinal edges 38 and 40 of the right front and right back fabric pieces 16 and 18 with one end of the inverted seam 52 curving outwardly to the longitudinal edges 38 and 40 at the first seam inversion point 54. The first inverted seam 52 forms the seam allowances 102 and 103.

Two corresponding slits 56 and 57 are cut in the right front and right back fabric pieces 16 and 18, which are transverse to the longitudinal edges 38 and 40. The length of the slits are preferably less than the predetermined width of the seam allowances 102 and 103. The right front and right back fabric pieces 16 and 18 are inverted and folded at the first inverted seam 52 such that the outer sides 43 and 47 of the right front and right back fabric pieces 16 and 18 oppose each other. The lower portions of the longitudinal edges 38 and 40 are then aligned with each other. A first non-inverted seam 50 is sewn on the inner sides 42 and 46 of the right front and right back fabric pieces 16 and 18 from the bottom edges 25 and 27 of the right front and right back fabric pieces 16 and 18 up to the first seam inversion point 54. The overlapping seam 58 is sewn from the first seam inversion point 54 upwardly and curving outwardly to the first inverted seam 52. The overlapping 58 seam is sewn on the inner sides 42 and 46 of the right front and right back fabric pieces 16 and 18 with the seam allowances 102 and 103 folded therebetween. The overlapping seam preferably extends upwardly from the first seam inversion point 54 approximately ⅛" to ¾". However, it will be apparent to those in the art that a greater or lesser length may be sewn. The first non-inverted seam 50 is laterally spaced from the longitudinal edges 38 and 40 of the right front and right back fabric pieces 16 and 18, thereby forming the seam allowances 100 and 101.

In constructing the pant garment 20, shown in FIGS. 1 through 4, the same method described above is followed for sewing alternating seams 11, 12 and 13. Finally, inner leg seams 33 and 34 are sewn to complete the garment. Inner leg seam 33 is a non-inverted seam and extends from the bottom edges 25 and 27 along the right inner leg fabric edges (not-shown) to the bottom portions of the inner edges 29, 30, 31 and 32. Inner leg seam 34 is a non-inverted seam and extends from the bottom edges 26 and 28 along the left inner leg fabric edges (not-shown) to the bottom portions of the inner edges 29, 30, 31 and 32. A desired hem may be sewn along the bottom edges 25–28 of the pant garment 20 and the upper edges 21–24 may be surged as described below.

In one preferred embodiment all seams, including non-inverted, inverted, and overlapping seams, are surged seams, which is well-known in the art. Surging fabric edges reducing fraying of the material and is particularly suitable for stretchable fabrics, such as knits. In one preferred embodiment the seam allowances 100 and 101, 104 and 105, 108 and 109, and 112 and 113 of the non-inverted seams 50, 60, 70 and 80, respectively, are between ⅛" and ⅞" wide, and the seam allowances 102 and 103, 106 and 107, 110 and 111, and 114 and 115 of the inverted seams 52, 62, 72, and 82, respectively, are between ⅛" and ⅞" wide. It will be apparent to those in the art that the seam allowances can have virtually any width. Generally, the larger the width of the seam allowances, the more bulky the garment will be at the seams.

The use of a pant garment 20, as shown in FIGS. 1 through 4, is simple, easy and comfortable. The garment can be sized for males and females, by adjusting the size of the fabric pieces. To wear the garment 20, a person puts both legs through the opening formed by the upper edges 21–24 of the fabric pieces 16–19, respectively, and pulls the garment 20 up around the person's waist. The upper edges 21–24 can be rolled down by first folding down the upper edges 21–24 to create an upper fold. The upper fold can then be folded down one or more times as necessary to form a rolled waistband having a desired width and placement on the person's body. In particular, for a garment having 6-inch inverted seams, the upper edges 21–24 can be rolled down to form a waistband approximately 3 inches in width or less. The waistband is movable upwardly or downwardly around the person's waist area, as desired. By rolling down the upper portion of the garment 20 the seam allowances of the inverted seams 52, 62, 72 and 82 will be concealed, and a rolled waistband will be formed at a desired location on the wearer's body. This use of the garment 20 will be the same whether the garment 20 is a pair of pants, shorts, skorts, leggings, skirt or the like.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

The claimed invention is:

1. An alternating seam for joining first and second pieces of stretchable fabric, each of the first and second fabric pieces having inner and outer sides, an upper edge and at least one longitudinal edge, said alternating seam comprising:

a non-inverted seam joining the first and second fabric pieces, said non-inverted seam extending from a seam inversion point to a desired length below said seam inversion point, said seam inversion positioned at a predetermined location below the upper edge of at least one of the first and second fabric pieces;

said outer side of said first fabric piece and said outer side of said second fabric piece in opposing contact with each other along said non-inverted seam;

an inverted seam joining the first and second fabric pieces, said inverted seam extending upwardly from said seam inversion point toward the upper edges of the first and second fabric pieces; and said inner side of said first fabric piece and said inner side of said second fabric piece in opposing contact with each other along said inverted seam.

2. The alternating seam according to claim 1 wherein said seam inversion point includes first and second slits extending inwardly from the longitudinal edges of the first and second fabric pieces a predetermined slit distance.

3. The alternating seam according to claim 2 wherein each of said first and second slits are between ⅛ of an inch and ¾ of an inch in length.

4. The alternating seam according to claim 1 wherein a portion of said inverted seam is laterally spaced from upper portions of said longitudinal edges of said first and second fabric pieces;

said inverted seam having one end curving outwardly from said laterally spaced portion of said inverted seam to the longitudinal edge of at least one of the first and second fabric pieces, said one end being adjacent to said seam inversion point.

5. The alternating seam according to claim 4 wherein said inverted seam forms two seam allowances disposed between said inverted seam and the upper portions of the longitudinal edges of the first and second fabric pieces, respectively, the two seam allowances folded between the first and second fabric pieces when the outer sides of the first and second fabric pieces oppose each other.

6. The alternating seam according to claim 5 wherein said non-inverted seam further includes an overlapping seam extending upwardly from said seam inversion point and curving outwardly to said inverted seam, said overlapping seam extending a predetermined overlap length above said seam inversion point;

said overlapping seam sewn on the inner sides of the first and second fabric pieces with the two seam allowances folded between the outer sides of the first and second fabric pieces.

7. The alternating seam according to claim 6 wherein said predetermined overlap length is between ⅛ of an inch and ¾ of an inch long.

8. A garment comprising:

at least front and back pieces of stretchable fabric, each of said front and back fabric pieces having inner and outer sides, first and second longitudinal edges, and an upper edge;

a. a first alternating seam comprising:

i. a first non-inverted seam joining said front and back fabric pieces, said first non-inverted seam extending from a first seam inversion point to a desired length below said first seam inversion point, said first seam inversion positioned at a first predetermined location below at least one of said upper edges of said front and back fabric pieces; and ii. a first inverted seam joining said front and back fabric pieces, said first inverted seam extending upwardly from said first inversion point;

b. a second alternating seam comprising:

i. a second non-inverted seam joining said front and back fabric pieces, said second non-inverted seam extending from a second seam inversion point to a desired length below said second seam inversion point, said second seam inversion point positioned at a second predetermined location below at least one of said upper edges of said front and back fabric pieces; and ii. a second inverted seam joining said front and back fabric pieces, said second inverted seam extending upwardly from said second inversion point;

c. said outer side of said front fabric piece and said outer side of said back fabric piece in opposing contact with each other along each of said first and second non-inverted seams; and d. said inner side of said front fabric piece and said inner side of said back fabric piece in opposing contact with each other along each of said first and second inverted seams.

9. The garment according to claim 8 wherein said first seam inversion point includes two slits, one slit extending inwardly from said first longitudinal edge of said front fabric piece and the other slit extending inwardly from said first longitudinal edge of said back fabric piece; and said second seam inversion point includes two slits, one slit extending inwardly from said second longitudinal edge of said front fabric piece and the other slit extending inwardly from said second longitudinal edge of said back fabric piece.

10. The garment according to claim 9 wherein each of said two slits of said first seam inversion point is between ⅛ of an inch and ¾ of an inch in length; and wherein each of said two slits of said second seam inversion point is between ⅛ of an inch and ¾ of an inch in length.

11. The garment according to claim 8 wherein a portion of said first inverted seam is laterally spaced from an upper portion of said first longitudinal edge of said front fabric piece and an upper portion of said first longitudinal edge of said back fabric piece;

said first inverted seam having one end curving outwardly from said laterally spaced portion of said first inverted seam to at least one of said first longitudinal edges of said front and back fabric pieces; and wherein a portion of said second inverted seam is laterally spaced from an upper portion of said second longitudinal edge of said front fabric piece and an upper portion of said second longitudinal edge of said back fabric piece;

said second inverted seam having one end curving outwardly from said laterally spaced portion of said second inverted seam to at least one of said second longitudinal edges of said front and back fabric pieces.

12. The garment according to claim 11 wherein:

said first inverted seam forms two first inverted seam allowances, one first inverted seam allowance disposed between said first inverted seam and said upper portion of said first longitudinal edge of said front fabric piece, the other one of said first inverted seam allowances disposed between said first inverted seam and said upper portion of said first longitudinal edge of said back fabric piece, said two first inverted seam allowances folded between said front and back fabric pieces when said outer sides of said front and back fabric pieces oppose each other; and said second inverted seam forms two second inverted seam allowances, one second inverted seam allowance disposed between said second inverted seam and said upper portion of said second longitudinal edge of said front fabric piece, the other one of said second inverted seam allowances disposed between said second inverted seam and said upper portion of said second longitudinal edge of said back fabric piece, said two second inverted seam allowances folded between said front and back fabric pieces when said outer sides of said front and back fabric pieces oppose each other.

13. The garment according to claim 12 wherein said first non-inverted seam further includes an overlapping seam extending upwardly from said first seam inversion point and curving outwardly to said first inverted seam, said overlapping seam extending a first predetermined overlap length above said first seam inversion point;

said overlapping seam of said first non-inverted seam sewn on said inner sides of said front and back fabric pieces with said two first inverted seam allowances folded between said outer sides of said front and back fabric pieces; and wherein said second non-inverted seam further includes an overlapping seam extending upwardly from said second seam inversion point and curving outwardly to said second inverted seam, said overlapping seam extending a second predetermined overlap length above said second seam inversion point;

said overlapping seam of said second non-inverted seam sewn on said inner sides of said front and back fabric pieces with said two second inverted seam allowances folded between said outer sides of said front and back fabric pieces.

14. The garment according to claim 13 wherein each of said first and second predetermined overlap lengths is between ⅛ of an inch and ¾ of an inch long.

15. The garment according to claim 11 wherein:

each of said first and second longitudinal edges of said front and back fabric pieces has a point of inflection, said first and second longitudinal edges of said front fabric piece configured such that a top portion of said front fabric piece is more narrow than a bottom portion of said front fabric piece;

said first and second longitudinal edges of said back fabric piece mirroring the contour of said first and second longitudinal edges of said front fabric piece, respectively;

said first seam inversion point fixed above said inflection points on said upper portions of said first longitudinal edges of said front and back fabric pieces;

said second seam inversion point fixed above said inflection points on said upper portions of said second longitudinal edges of said front and back fabric pieces.

16. The garment according to claim 8 wherein said first and second seam inversion points are in substantially horizontal alignment.

17. The garment according to claim 16 wherein:

said first seam inversion point is between 5 and 7 inches below said upper edges of said right front and back fabric pieces; and said second seam inversion point is between 5 and 7 inches below said upper edges of said left front and back fabric pieces.

18. The garment according to claim 8 further comprising a leg seam joining said front and back fabric pieces and forming two leg receiving portions.

19. The garment according to claim 8 wherein said front fabric piece comprises right and left front fabric pieces, said right front fabric piece adjoining said first longitudinal edge of said front fabric piece and said left front fabric piece adjoining said second longitudinal edge of said front fabric piece;

said right front fabric piece having an inner edge and said left front fabric piece having an inner edge, said inner edges of said right and left front fabric pieces opposing each other; and wherein said back fabric piece comprises right and left back fabric pieces, said right back fabric piece adjoining said first longitudinal edge of said back fabric piece and said left back fabric piece adjoining said second longitudinal edge of said back fabric piece;

said right back fabric piece having an inner edge and said left back fabric piece having an inner edge, said inner edges of said right and left back fabric pieces opposing each other.

20. The garment according to claim 19 further comprising:

a. a third alternating seam comprising:

i. a third non-inverted seam joining said right and left front fabric pieces, said third non-inverted seam extending downwardly from a third seam inversion point to a desired length below said third seam inversion point, said third seam inversion point being in substantially horizontal alignment with at least one of said first and second seam inversion points; and ii. a third inverted seam joining said right and left front fabric pieces, said third inverted seam extending upwardly from said third seam inversion point; and b. a fourth alternating seam comprising:

i. a fourth non-inverted seam joining said right and left back fabric pieces, said fourth non-inverted seam extending downwardly from a fourth seam inversion point to a desired length below said fourth seam inversion point, said fourth seam inversion point being in substantially horizontal alignment with at least one of said first and second seam inversion points; and ii. a fourth inverted seam joining said right and left back fabric pieces, said fourth inverted seam extending upwardly from said fourth seam inversion point.

21. The garment according to claim 20 wherein:

said third seam inversion point is between 5 and 7 inches below said upper edges of said right front and left front fabric pieces; and said fourth seam inversion point is between 5 and 7 inches below said upper edges of said right back and left back fabric pieces.

22. A method of sewing an alternating seam comprising the steps of:

providing at least front and back stretchable fabric pieces each having outer and inner sides, first and second longitudinal edges, and an upper edge;

aligning said first longitudinal edge of said front fabric piece with said first longitudinal edge of said back fabric piece, said inner side of said front fabric piece in opposing contact with said inner side of said back fabric piece;

sewing an inverted seam on said outer sides of said front and back fabric pieces to join said front and back fabric pieces, said inverted seam laterally spaced from an upper portion of said first longitudinal edges of said front and back fabric pieces and having one end curving outwardly to at least one of said longitudinal edges of said front and back fabric pieces;

making two slits adjacent to said one end of said inverted seam, one of said slits extending inwardly from said first longitudinal edge of said front fabric piece, the other one of said slits extending inwardly from said first longitudinal edge of said back fabric piece;

inverting said front and back fabric pieces such that said outer sides of said front and back fabric pieces are in opposing contact and said first longitudinal edge of said front fabric piece is in alignment with said first longitudinal edge of said back fabric piece;

sewing a non-inverted seam on said inner sides of said front and back fabric pieces to join said front and back fabric pieces, said non-inverted seam extending from said two slits to a desired length below said two slits; and sewing an overlapping seam extending upwardly from said non-inverted seam and curving outwardly to said first inverted seam.

* * * * *